United States Patent [19]

Davis

[11] Patent Number: 4,616,834

[45] Date of Patent: Oct. 14, 1986

[54] BALL-KICKING ASSEMBLY

[76] Inventor: Roy J. Davis, 940 Berkeley Ave., Menlo Park, Calif. 94026

[21] Appl. No.: 722,696

[22] Filed: Apr. 12, 1985

[51] Int. Cl.[4] ..... A63B 43/00; A63B 69/00

[52] U.S. Cl. ..... 273/411; 273/58 C; 273/413

[58] Field of Search ..... 273/411, 413, 58 C, 273/26 E, 197 R, 197 A, 29 A

[56] References Cited

U.S. PATENT DOCUMENTS

| | | | |
|---|---|---|---|
| 2,823,038 | 2/1958 | White | 273/197 R |
| 3,288,413 | 11/1966 | Gregory | 273/411 X |
| 3,498,613 | 3/1970 | Dreyer | 273/413 |
| 4,307,888 | 12/1981 | Ohle | 273/413 |
| 4,462,599 | 7/1984 | Brown | 273/413 X |

*Primary Examiner*—William H. Grieb

*Attorney, Agent, or Firm*—Flehr, Hohbach, Test, Albritton & Herbert

[57] ABSTRACT

A ball-kicking assembly employing a relatively heavy mounting base and a pivot post extending upwardly out of the base supports a semi-rigid radius arm to rotate therearound. The radius arm mounts to the pivot post in a manner permitting the radius arm to rotate about and to move along the pivot post whereby different sizes of balls carried on the outer end of the radius arm can be employed. The outer end of the radius arm carries a ball mounted for rotation about the radius arm axis.

4 Claims, 3 Drawing Figures

FIG_3
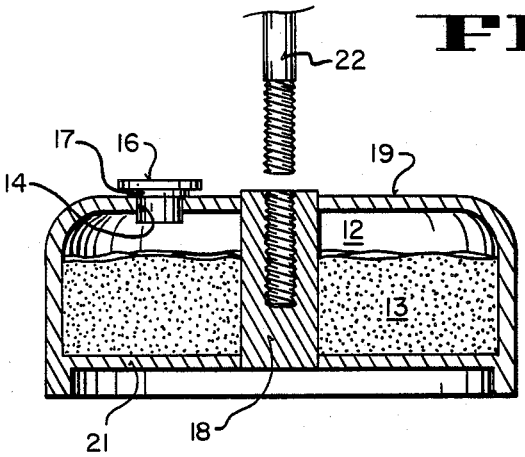
FIG_2
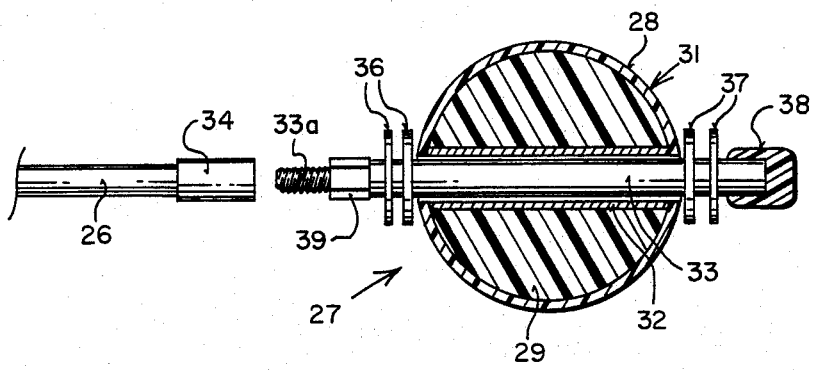
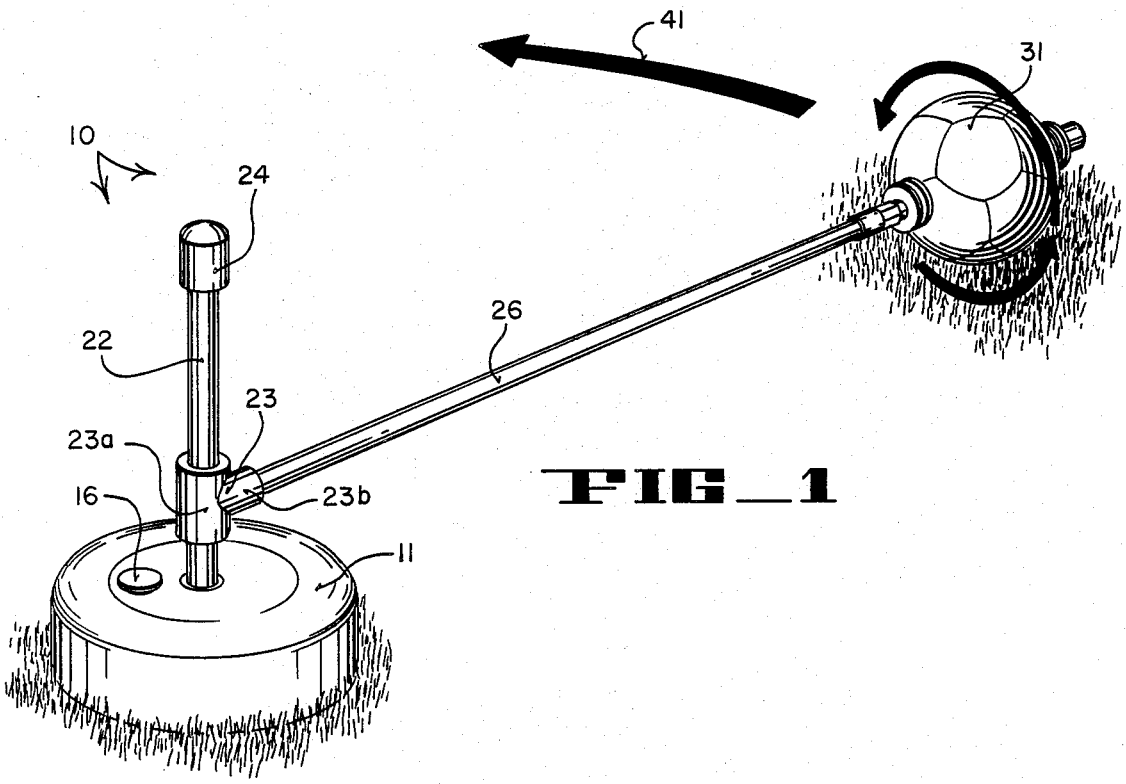
FIG_1

BALL-KICKING ASSEMBLY

This invention pertains to a ball-kicking assembly and more particularly to such assembly useful in a confined play yard or the like.

The ball-kicking assembly disclosed herein permits a person to practice kicking balls, such as a soccer ball or the like, without requiring that the participant retrieve the soccer ball after each kick, or need a partner to kick it back. Accordingly, a young child can play with this particular apparatus in his own back yard or indoors without requiring the expanse normally involved in kicking soccer balls and the like across relatively large fields.

In addition, the present apparatus is arranged in a manner whereby various sizes of balls can be readily attached to the end of a radius arm for use by children of different ages.

Thus, as provided herein a ball-kicking assembly has been provided whereby a person can practice kicking a ball on the ground in relatively confined spaces.

In general there has been provided a ball-kicking assembly having a mounting base of substantial weight supporting an upwardly extending pivot post. An elongate semi-rigid radius arm coupled by means of a sliding "T" connection to the pivot post carries a ball at the outer end of the radius arm in a manner permitting the ball to rotate about the axis of the radius arm while rolling along the ground. The inner end of the radius arm coupled to the sliding "T" connection permits the radius arm to travel freely about and along the axis of the pivot post so as to accommodate balls of various sizes at the outer end of the radius arm.

In general, it is an object of the present invention to provide a ball-kicking assembly for use in relatively confined spaces.

It is another object of the present invention to provide a ball-kicking assembly of a type wherein the ball is adapted to roll along the ground after it is kicked and to return to the kicker.

Yet another object of the invention is to provide an improved ball-kicking assembly in which various sizes of balls can be readily mounted and demounted from the outer end of the radius arm for use by children of different sizes and abilities.

The foregoing and other objects of the invention will become more readily evident from the following detailed description of a preferred embodiment when considered in conjunction with the drawings.

FIG. 1 shows a diagrammatic perspective view of a ball-kicking assembly according to the invention;

FIG. 2 shows an enlarged, exploded diagrammatic view of a ball assembly with portions in section; and FIG. 3 shows an enlarged elevation section view of the base of the ball-kicking assembly according to the invention.

DETAILED DESCRIPTION OF A PREFERRED EMBODIMENT

A ball-kicking assembly 10 includes a relatively heavy or high mass mounting base assembly 11 having a generally hollow interior 12 for receiving water or sand 13 or other suitable material for applying additional weight to base assembly 11. An access port 14 sealed by means of a threaded cap or plug 16 permits sand 13 to be poured into interior 12.

A support post 18 serves to provide rigid spacing between the top and bottom 19, 21 of base 11.

Post 18 includes a counterbore threaded to receive the threaded lower end of a pivot post 22 defining an elongate upstanding rigid pivot axis carried by base 11.

Post 22 carries a removable cap 24 for purposes described further below.

Means for supporting a ball assembly 27 for movement around pivot post 22 includes a "T" shaped coupling 23. The transverse top portion **23*a* of the "T" lies coaxially of the pivot post 22 to freely rotate around and move axially along post 22. Cap 24, fits snugly and tightly onto the upper end of post 22, and serves to retain the "T" shaped coupling 23** thereon.

An elongate semi-rigid radius arm coupled at one end to the stem portion **23*b* of coupling 23 extends therefrom along a radius. In this way the radius arm serves to move about pivot post 22**.

The outer end of radius arm 26 carries ball assembly 27 as best shown in FIG. 2 in a manner permitting the ball to rotate about the axis of radius arm 26 while rolling in engagement with a support surface therebeneath, such as grass, carpet, hardwood flooring, concrete, asphalt or the like, which is substantially flat and level. In the drawing, the support surface has been drawn to represent grass. Ball assembly 27 includes a hollow enclosure, envelope or shpere 28 of compliant material such as leather, vinyl plastic, etc. A resilient filler material such as polyurethanefoam 29 substantially fills enclosure 28 to simulate a soccer ball 31 or the like.

In order to permit ball 31 to roll along the ground as radius arm 26 rotates about pivot post 22, a hollow tube 32 extends through ball 31 along a diameter thereof. A spindle or extension rod 33 carries a connector comprising the nut portion 39 and threaded end **33*a* which attaches to a coupling 34 carried on the outer end of radius arm 26. As thus arranged extension rod 33 forms a continuation of the axis of radius arm 26. Sufficient clearance lies between tube 32 and rod 33 to permit ball 31 and tube 32 to rotate freely on rod 33**.

A number of different lengths of radius arms 26 can be employed as desired by unscrewing the opposite ends of arm 26 and replacing it with another. In addition threaded end **33*a* can be coupled directly into stem 23*a* of coupling 23** to provide a minimum length of radius arm.

Extension rod 33 carries means for limiting axial movement of ball 31 therealong so as to retain the axial position of ball 31 on rod 33. Accordingly, the outer end of rod 33 carried a cap 38 secured thereto while the inner end of rod 33 includes an enlarged nut portion 39. Washers 36, 37 carried at opposite ends of tube 32 ride on rod 33. It will be readily evident that both nut 39 and end cap 38 are larger than the center openings formed in washers 36, 37 so as to keep ball 31 from moving along rod 33 to any great extent.

In use, a number of ball assemblies 27 may each have a substantially different size of ball 31 depending upon the users of the equipment. Accordingly, as the ball becomes larger, it will be readily evident that the sleeve-like portion **23*a* of coupling 23 will move axially upwardly along pivot post 22**.

As ball 31 is kicked in the direction of arrow 41, ball 31 will rotate about the axis of radius arm 26 as ball 31 moves along the ground or other underlying support surface (such as a gymnasium floor or the like). Further, it will be readily evident that one ball assembly can be readily interchanged with another to quickly accommodate different classes of participants simply by unscrewing the threaded end 33*a* from coupling 34 and replacing ball assembly 27 with a different one in the manner described above.

An assembly of the kind described is expected to be primarily used by small children. By employing a semi-rigid radius arm the ball will travel a predictable path as distinguished from that of apparatus using a rope to attach to the ball. In addition, the semi-rigid radius arm cannot become tangled, either about the pivot post or around the foot of a child using the equipment. Further, in the assembly described above, the behavior of the ball is less complicated for small children whereby the child can repeat the kicking of the ball with a minimum of supervision and a maximum of success.

From the foregoing it will be readily evident that there has been provided a relatively simplified and highly useful ball-kicking assembly for use by children and others in relatively close quarters whereby the ball need not be retrieved after being kicked and having the advantages noted above relative to accommodating different sizes of balls carried on the outer end of radius arm 26.

I claim:

1. A ball kicking assembly comprising a mounting base of substantial mass, means carried to extend upwardly from said base for defining a pivot axis, an elongate semi-rigid radius arm, a ball carried by one end of said arm in a manner permitting the ball to rotate about the axis of said arm, the other end of said arm being coupled to the first named said means in a manner permitting said other end of said arm to travel freely about and along said axis to permit said arm to rise and fall along said axis to dispose said arm to extend a radius from said axis at a position along said axis serving to locate the ball adjacent to support surface, the rigidity of said radius arm serving to cause the ball to travel a predictable path preventing the ball from travelling toward said axis.

2. A ball-kicking assembly comprising a mounting base of substantial mass, means carried to extend upwardly from said base for defining a pivot axis, an elongate semi-rigid radius arm, a ball carried by one end of said arm in a manner permitting the ball to rotate about the axis of said arm, the other end of said arm being coupled to the first named said means in a manner permitting said arm to travel freely about said axis at a position along said axis disposing the ball adjacent a support surface, said ball comprising a hollow enclosure of compliant material, said enclosure being substantially filled with a resilient material, a hollow tube extending through said ball along a diameter thereof, an extension rod disposed in said hollow tube to permit the ball to rotate about the axis of said extension rod, and means for coupling said extension rod to the outer end of said arm to form a continuation of the axis of said arm.

3. A ball-kicking assembly according to claim 2 comprising washers carried by said extension rod at opposite ends of said hollow tube, and means carried by said extension rod for limiting axial movement of the washers therealong to retain the axial position of said ball of said rod.

4. A ball-kicking assembly comprising a mounting base adapted to rest upon a support surface, an elongate upstanding rigid pivot post carried by said base, means supporting a ball for movement around said post, the last-named said means including a "T" shaped coupling, the transverse top portion of the "T" being disposed coaxially of said post to freely rotate around and move axially along said post, a cap disposed onto the upper end of said pivot post for retaining said "T" shaped coupling thereon, an elongate semi-rigid radius arm coupled at one end to and extending from the step portion of said "T" shaped coupling to travel around said pivot post, a ball assembly carried by the other end of said radius arm in a manner permitting the ball to rotate about the axis of said radius arm while rolling in engagement with the support surface, said ball assembly comprising a hollow envelope of compliant material, said enclosure being substantially filled with a resilient material, a hollow tube extending through said ball along a diameter thereof, an extension rod disposed in said hollow tube to permit the ball to rotate about the axis of said extension rod, and means for coupling said extension rod to the outer end of said arm to form a continuation of the axis of said arm.

* * * * *